US010227756B2

(12) United States Patent
Bosio

(10) Patent No.: US 10,227,756 B2
(45) Date of Patent: Mar. 12, 2019

(54) SPRAYHEAD FOR A FAUCET, WITH AN IMPROVED CONTAINMENT CASING

(71) Applicant: AMFAG S.r.l., Casaloldo (MN) (IT)

(72) Inventor: Orlando Bosio, Casaloldo (IT)

(73) Assignee: AMFAG S.r.l., Casaloldo (IT)

( * ) Notice: Subject to any disclaimer, the term of this patent is extended or adjusted under 35 U.S.C. 154(b) by 18 days.

(21) Appl. No.: 15/211,049

(22) Filed: Jul. 15, 2016

(65) Prior Publication Data

US 2017/0016217 A1 Jan. 19, 2017

(30) Foreign Application Priority Data

Jul. 16, 2015 (IT) ..... 102015000035166

(51) Int. Cl.
*E03C 1/04* (2006.01)

(52) U.S. Cl.
CPC ..... *E03C 1/0404* (2013.01); *E03C 1/0405* (2013.01); *E03C 2001/0415* (2013.01)

(58) Field of Classification Search
USPC ..... 4/678
See application file for complete search history.

(56) References Cited

U.S. PATENT DOCUMENTS 6,175,872 B1 * 1/2001 Neumann ..... G10H 1/0066 709/200
6,619,567 B1 9/2003 Ouyoung
2014/0109311 A1 * 4/2014 Bosio ..... B05B 1/1618 4/678
2015/0184366 A1 7/2015 Zhang et al.

* cited by examiner

*Primary Examiner* — Lauren Crane
(74) *Attorney, Agent, or Firm* — Renner, Otto, Boisselle & Sklar LLP

(57) ABSTRACT

Sprayhead (1) for a faucet, of the type which is separable and can be independently handled with respect to a faucet body, comprising: an inlet union (2), having a connecting mouth connectable to an extractable water supply hose; a dispensing body (4), defining at least a first dispensing outlet (40) and a second dispensing outlet (41); a selector body (3), arranged between the inlet union (2) and the dispensing body (4) and having a selection mechanism (30) actuatable from the outside so as to place the connecting mouth (20) in fluid communication either with the first dispensing outlet (40) or with the second dispensing outlet (41); and a containment casing (5, 6) composed of two portions made of different materials: a structural portion (5), within which the selector body (3) is housed; and a functional portion (6), which covers at least partially said structural portion (5).

11 Claims, 6 Drawing Sheets

SPRAYHEAD FOR A FAUCET, WITH AN IMPROVED CONTAINMENT CASING

RELATED APPLICATION DATA

This application claims priority of Italian Patent Application No. 102015000035166 filed Jul. 16, 2015, which is hereby incorporated herein by reference.

FIELD OF APPLICATION

The present invention relates to a sprayhead for a faucet, of the type which is extractable or in any case separable with respect to the fixed main body of the faucet. Such sprayheads are generally referred to on the market as being of the "pull-down" type.

The aforementioned devices may be usefully applied in the sector of faucets or faucet accessories, in particular kitchen faucets.

PRIOR ART

Faucets provided with a "pull-down" sprayhead are nowadays widely used, in particular as mixers for kitchen sinks. They have a dispensing end-piece, commonly called sprayhead, which may be extracted or in any case separated from its seat on the neck of the mixer so as to allow effective orientation of the water jet. A flexible hose, generally inserted inside the mixer body, but partially extractable so as to accompany the movements of the sprayhead, keeps the latter connected to the water supply network.

These devices generally comprise internally a selection mechanism, which allows the user to convert the uniform central jet, typical of the faucet, into a broad spray similar to that of a shower.

The selection mechanism is a mechanical assembly of given complexity which is generally inserted inside a containment casing defined by a single-piece shell or sleeve which gives the sprayhead its structural integrity and defines the appearance thereof. The assembly including aerator which defines the different fluid outflows is usually inserted inside the same casing. The top union for the flexible hose may be incorporated in the body of the selection mechanism or may be made as a separate piece, being fixed inside the containment casing by means of a special flange.

The outer casing, depending on the specific technical or structural requirements, is made either of metallic material, for example brass or stainless steel, or alternatively plastic material.

This choice of material, while substantially complying with the requirements of the sector, nevertheless has a number of drawbacks described below.

In the region of the connection with the faucet, where any friction between the external casing and the receiving spout may occur, the metal or chrome-plated plastic of the casing could over time be subject to scratching and scuffing which would adversely affect its appearance. In order to avoid this, the external casing usually terminates below the top union, which thus remains the sole part inserted inside the faucet spout.

The metal also has a weight and a specific cost such that the containment casing is reasonably made with thin walls. The external dimension of the sprayhead is therefore substantially defined by the diameter of its internal components and in particular of its selector body. In order to adapt the sprayhead to the different diameters of the faucets present on the market, it is thus necessary to provide a range of internal components with different sizes. This results in an obvious increase in costs during both the design and production stages.

Other drawbacks associated with the external metal casing may be its high degree of conductivity, resulting in the need for specific measures to avoid the presence of heat bridges or the need to perform costly knurling operations in order to improve the grip for the user.

The technical problem underlying the present invention is therefore that of providing a separable sprayhead which overcomes entirely or partly the drawbacks mentioned with reference to the prior art.

SUMMARY OF THE INVENTION

The aforementioned technical problem is solved by a sprayhead for a faucet, of the type which is separable and can be independently handled with respect to a faucet body, comprising: an inlet union, having a connecting mouth connectable to an extractable water supply hose; a dispensing body, defining at least a first dispensing outlet and a second dispensing outlet; a selector body, arranged between the inlet union and the dispensing body and having a selection mechanism actuatable from the outside so as to place the connecting mouth in fluid communication either with the first dispensing outlet or with the second dispensing outlet; and a containment casing which encloses at least said dispensing body, said containment casing comprising two portions made of different materials: a structural portion, within which the selector body is housed; and a functional portion, which covers at least partially said structural portion.

Owing to the subdivision of the external casing into separate portions made of different materials, it is possible to continue using the metallic materials traditionally used (for example stainless steel or brass) for the structural portion alone, while the functional portion may be advantageously made of any material, for example a plastic material, chosen in order to satisfy the specific functional requirements of the device. Alternatively, two plastics with different characteristics may be used for the structural portion and for the functional portion. For example, the structural portion may be made using plastic which is reinforced—with glass fibre, carbon or the like—while the functional portion may be made of a plastic or rubber which has particular functional or aesthetic properties, such ABS plastic suitable for chrome-plating.

The functional portion of the casing thus performs advantageously one or more functions different from the purely structural function.

A functional portion made of plastic material may for example perform a heat-insulation function, preventing the transmission of heat to the handle.

A functional portion made of low-friction rigid plastic, for example a self-lubricating plastic, may be advantageously introduced inside the spout of the overlying faucet, allowing easy extraction without the risk of unattractive scuffing due to friction.

A functional portion made instead of a soft plastic with a high friction coefficient, for example a soft silicone, may be provided in order to facilitate gripping by a user.

The functional portion may also define an external volume which is substantially bigger than that of a thin-wall structural portion over which it is fitted, thus allowing a single functional core to be adapted to a plurality of faucet sizes produced in the market.

It can also be noted how the functional portion may be easily decorated, for example by means of silkscreen printing or the like, allowing desired aesthetic effects to be achieved at a low production cost.

The structural portion and the functional portion may be combined by means of a reversible or irreversible snap-engaging connection, threaded connection, co-moulding, bonding or any other method known in the art.

Preferably, the structural portion defines a housing sleeve within which a portion of said inlet union, said selector body, and at least a portion of said dispensing body are contained. The functional portion is arranged over this housing sleeve such that the latter defines an inner core for the surrounding functional portion.

The functional portion may define externally a gripping portion which may, if necessary, be arranged over a bottom section where the structural portion remains however visible or may instead completely cover the structural portion.

The sprayhead comprises a device for actuating the selection mechanism which can be accessed from the outside, said actuating device preferably crossing an internal through-hole and an external through-hole which are aligned with each other and respectively formed in a lateral surface of the housing sleeve and in a lateral surface of the functional portion.

The actuating device may comprise a pushbutton movable in a direction transverse to the longitudinal axis of the sprayhead, pressing of said pushbutton causing the movement of a longitudinal rod of the selection mechanism and the consequent modification of the dispensing outlet placed in fluid communication with the connecting mouth.

The pushbutton has preferably a terminal nose which defines an inclined surface which slidably engages over an opposite inclined surface formed on the longitudinal rod.

Advantageously, this actuating device comprises elastic return means for bringing said pushbutton back into an external end-of-travel position following release of the pressing action by the user.

The elastic return means may comprise in particular at least one spring inserted inside a dedicated internal cavity of the pushbutton. Preferably, the springs consist of a plurality inserted in a corresponding number of cavities arranged with central symmetry along a peripheral section of the pushbutton or may be defined by elastic portions formed integrally with the remainder of the pushbutton. Other equivalent technical solutions may obviously be used.

The travel of the pushbutton may be advantageously guided within the dispensing body by means of a sliding connection with trapezoidal teeth. This sliding connection is formed by opposite profiles with trapezoidal teeth which are respectively formed on two opposite and parallel internal walls of the selector body and on two side walls of the pushbutton nose. Said profiles are shaped matching each other with sufficient play, so as to allow guided sliding of the pushbutton nose inside the internal walls of the selector device.

It can be noted how the characteristic features of the embodiment of the device, as outlined above and further explained in the detailed description below, are per se innovative, independently of their application to a composite external casing according to the present invention.

Further characteristic features and advantages will emerge more clearly from the detailed description provided hereinbelow of a preferred, but not exclusive embodiment of the present invention, with reference to the attached figures, provided by way of a non-limiting example.

DETAILED DESCRIPTION

With reference to the attached figures, 1 denotes generically an extractable sprayhead of the pull-down type, intended to be combined with a faucet, not shown, preferably a kitchen mixer faucet.

It should be noted that the sprayhead 1 may be marketed separately from the faucet body with which it is associated.

Figure 1:
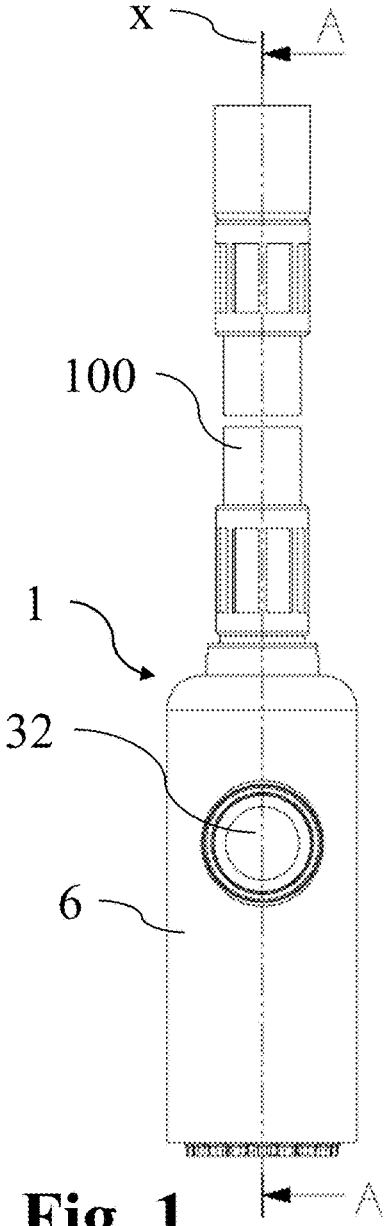
FIG. 1 shows a front view of the sprayhead according to the present invention.
Figure 2:
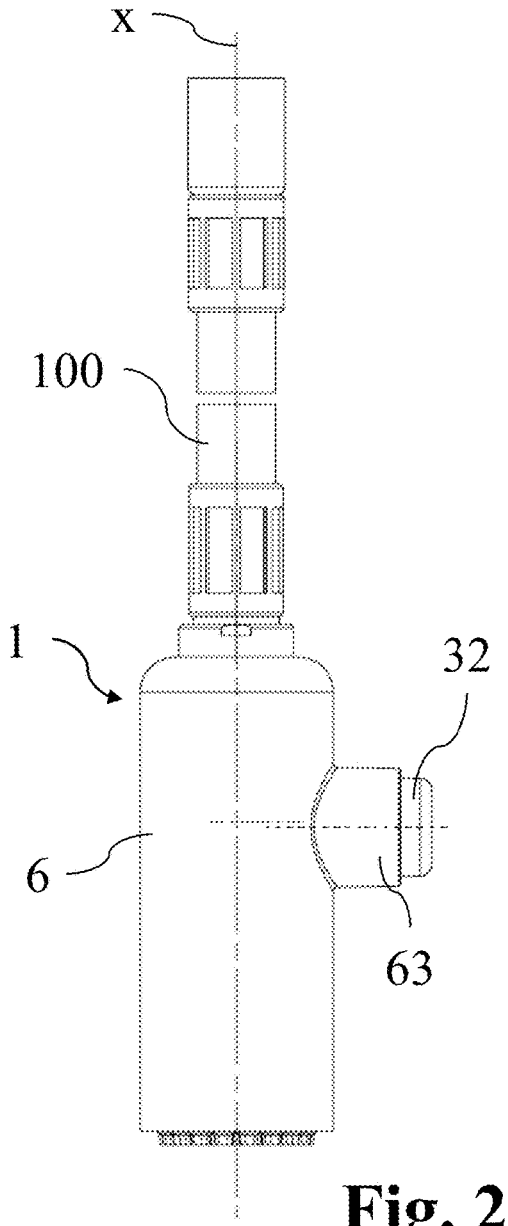
FIG. 2 shows a side view of the sprayhead according to FIG. 1.
Figure 3:
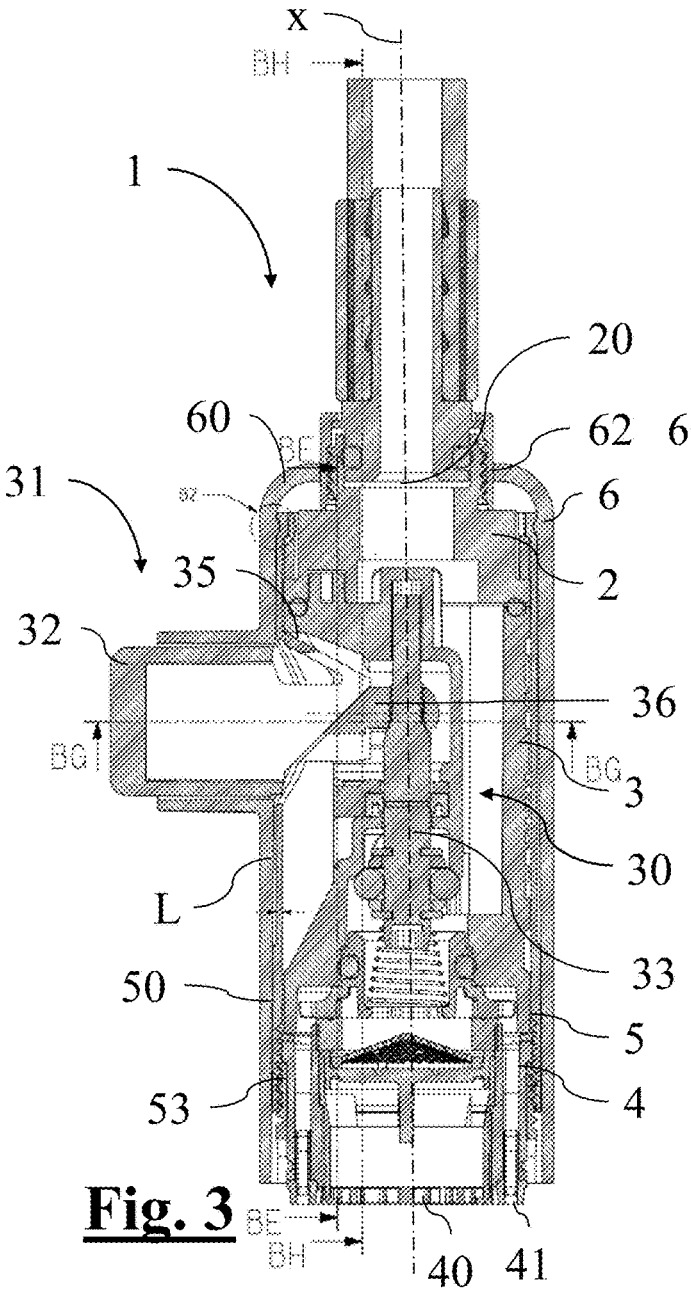
FIG. 3 shows a view of the sprayhead sectioned along the axis A-A of FIG. 1.

The sprayhead 1 is shown in FIGS. 1, 2 and 3 in a specific, preferred, vertical, operative configuration; in the continuation of the present description, the relative and absolute positions and the orientations of the various elements which form the unit—defined by means of terms such as "upper" and "lower", "above" and "below", "horizontal" and "vertical" or other equivalent terms—must always be interpreted with reference to this configuration. In no case, therefore, must any limiting value be attributed to them.

The sprayhead 1, which extends along a vertical longitudinal axis x, comprises a containment casing 5, 6 inside which the following internal components are housed, arranged above one another: a top inlet union 2, an intermediate selector body 3 and a bottom dispensing body 4.

The containment casing is composed of two portions which are closely combined: a structural portion 5 made of metallic material and a functional portion 6 made of plastic material.

The structural portion 5 has a tubular structure defined by a housing sleeve 50 provided at the base with an internal thread 53. The containment sleeve 50 has a more or less uniform thickness L, preferably of less than 1 millimetre: for example 0.5 mm. A slight outwards protrusion is provided only at the base.

The functional portion 6 is advantageously made of a self-lubricating rigid plastic, such that it may be easily introduced without causing damage inside a faucet spout of suitable dimensions.

The functional portion 6, with a uniform-diameter wall, has a cylindrical main part which is fitted over the housing sleeve 5, covering it completely, and a top union 60 which defines a top opening 62.

Figure 3A:
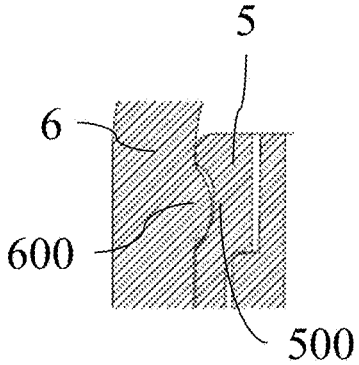
FIG. 3*a* shows an enlarged detail BZ of the view according to FIG. 3.

The cylindrical main part of the functional portion 6 is irreversibly engaged over the housing sleeve 50 of the structural portion 5 via snap-engaging means shown in the detail of FIG. 3*a*. In the case in question, these snap-engaging means take the form of a cylindrical groove 500 which is formed close to the top end of the housing sleeve 50 and inside which a relief 600 formed inside the functional portion 6 is introduced.

Figure 5:
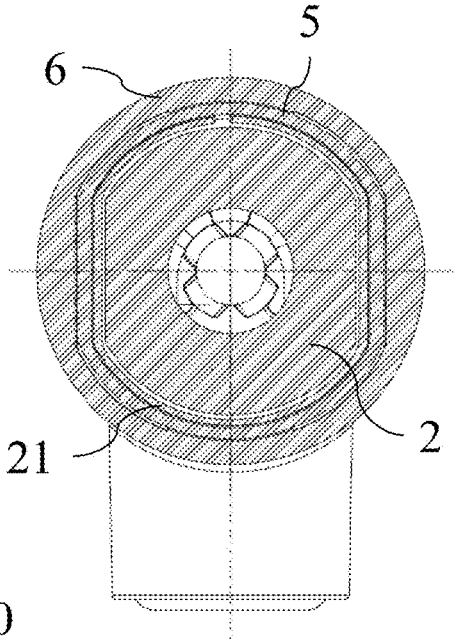
FIG. 5 shows a view of the sprayhead sectioned along the axis BP-BP of FIG. 4.
Figure 6:
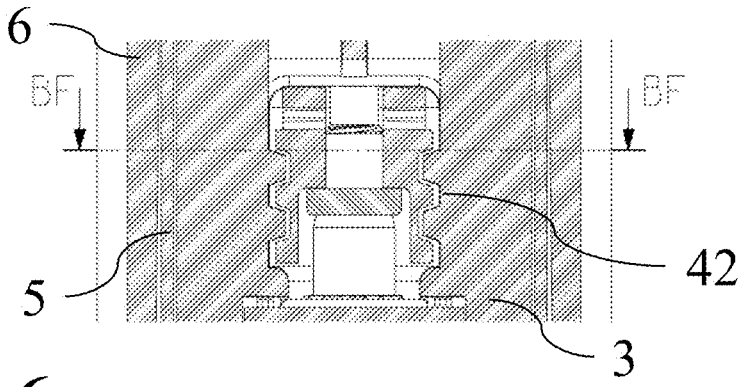
FIG. 6 shows a view of the sprayhead sectioned along the axis BE-BE of FIG. 3.
Figure 7:
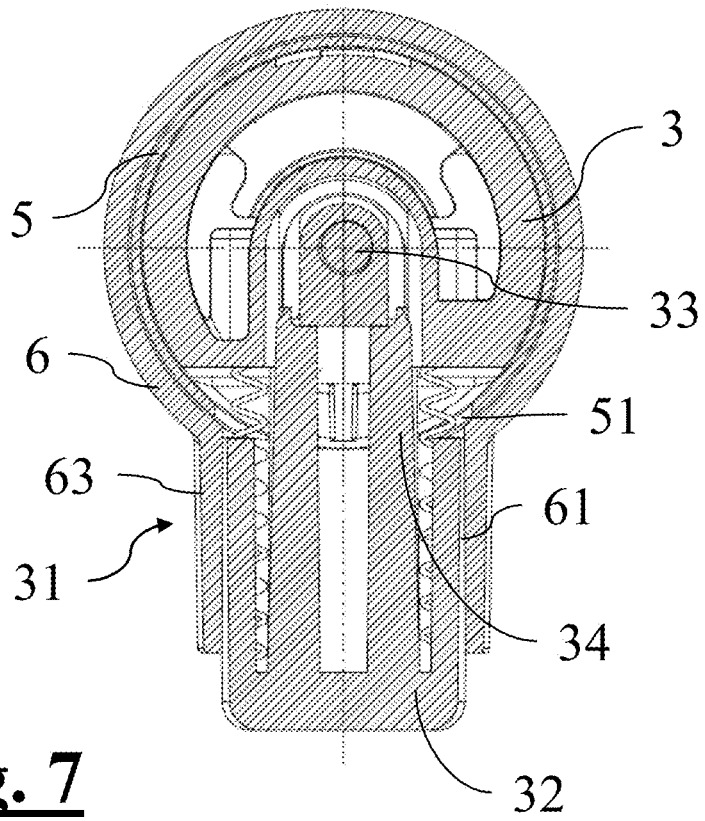
FIG. 7 shows a view of the sprayhead sectioned along the axis BF-BF of FIG. 6.
Figure 8:
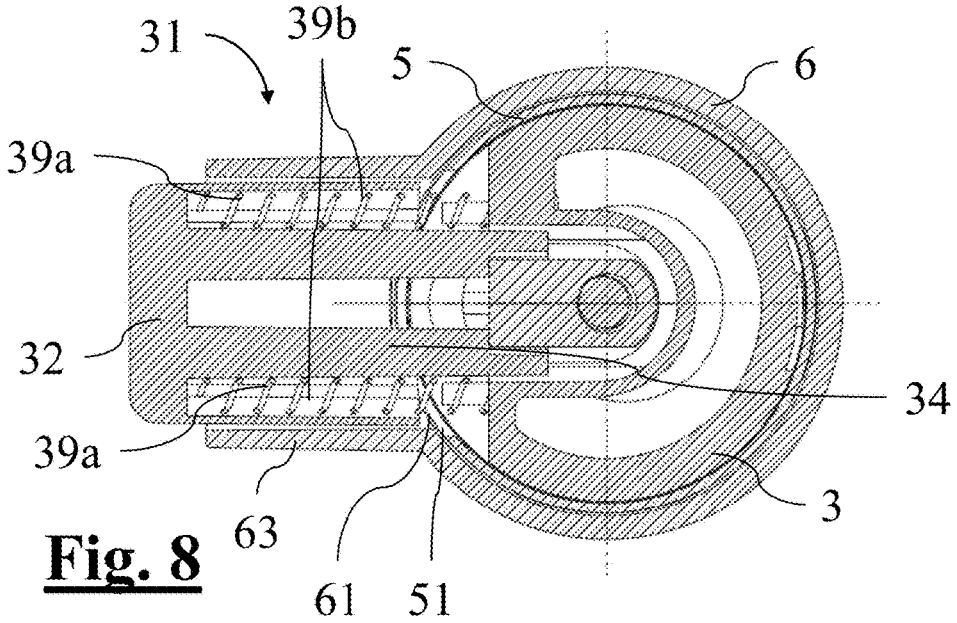
FIG. 8 shows a view of the sprayhead sectioned along the axis BG-BG of FIG. 3.
Figure 9:
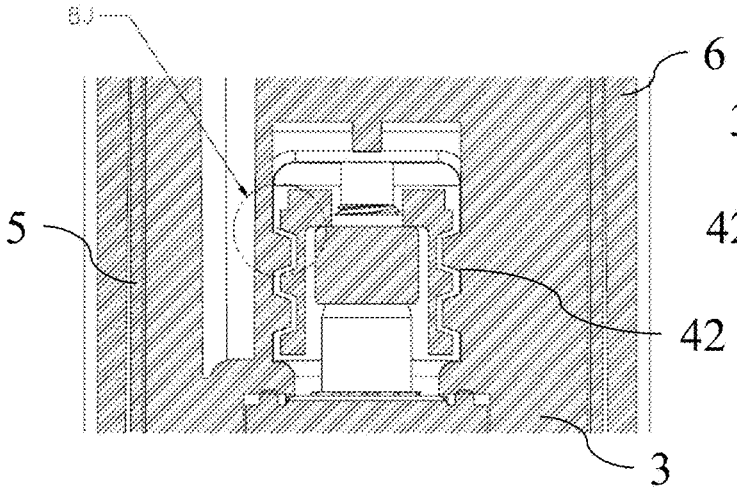
FIG. 9 shows a view of the sprayhead sectioned along the axis BH-BH of FIG. 3.
Figure 9A:
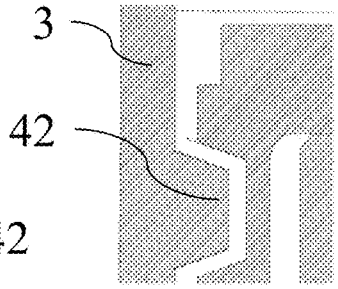
FIG. 9*a* shows an enlarged detail BJ of the view according to FIG. 9.

The cylindrical main part of the functional portion 6 has, only at its top end, an internal section provided with two flattened faces and designed to be coupled in a rotationally fixed manner with a similarly shaped profile assumed by the top end of the housing sleeve 50, as can be seen in FIG. 5.

The housing sleeve 50 and the cylindrical main part of the functional portion 6 also have, on the cylindrical contact walls, an internal through-hole 51 and an external through-hole 61, respectively. These holes are aligned with each other so as to allow an operating pushbutton, described below, to pass through. The functional portion 6 also has, surrounding the external through-hole 61, a guide bush 63 which projects outwards and inside which said pushbutton 32 slides.

The inlet union 2, the selector body 3 and the dispensing body 4 are inserted, arranged on top of each other, inside the bore of the structural portion 5 of the containment casing. The three elements are not fixed to each other, but are kept tightly together in position by a threaded connection of the dispensing body 4 with the internal thread 53 of the structural portion 5.

Figure 4:
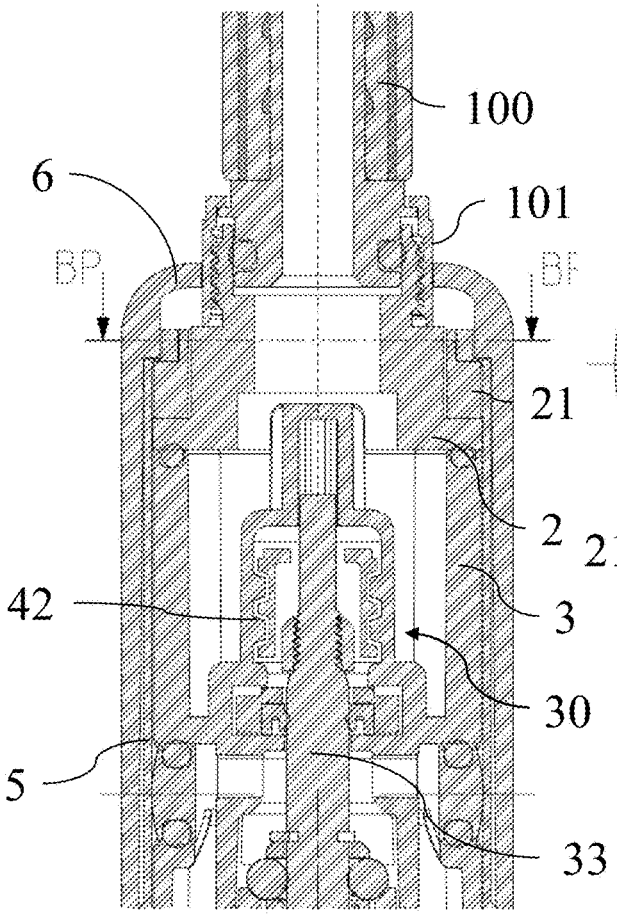
FIG. 4 shows a view of the sprayhead sectioned along the axis BM-BM of FIG. 3*b;*

The inlet union 2 allows the connecting mouth 20 to be connected to an extractable water supply hose 100 in a manner known per se illustrated in the detail of FIG. 4. The top union 60 conceals only partially from view the connection between inlet union 2 and tube 100, a fixing bush of which passes through the top opening 62 having a diameter which matches it.

The inlet union 2 has a bottom flange locked inside the housing sleeve 50 via an anti-rotation connection ring 21.

The selector body 3 defines internally a fluid path in communication with the connecting mouth 20, which may be made to flow either towards a first central dispensing outlet 40 or towards a second peripheral dispensing outlet 41 of the underlying dispensing body 4.

Figure 3B:
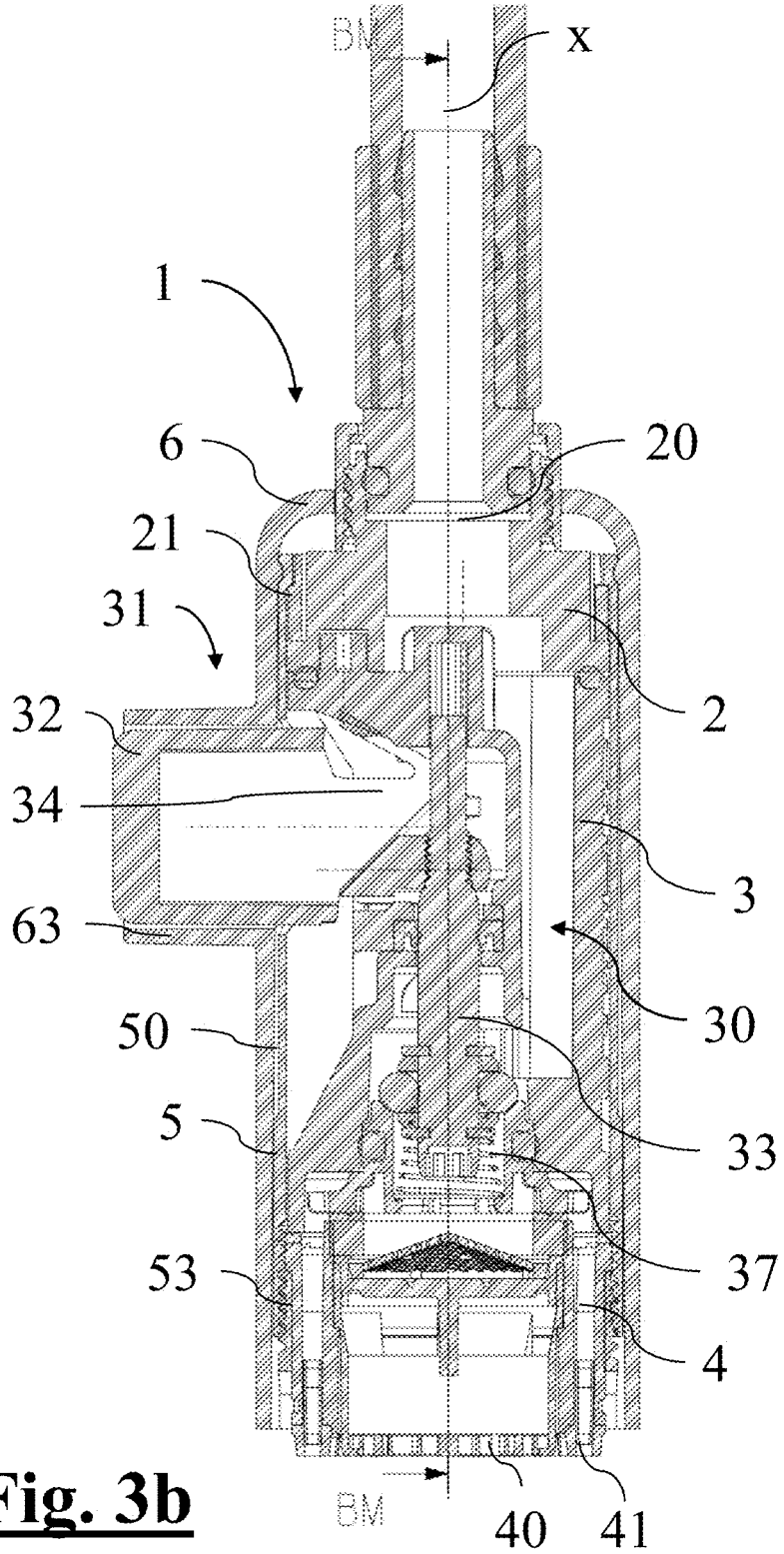
FIG. 3*b* shows the cross-sectioned view of FIG. 3 in a sprayhead configuration with the pushbutton pressed.

The selector body 3 comprises in particular a selection mechanism 30 provided with a longitudinal rod 33 having a closing member which, in the raised position shown in FIG. 3, blocks the access of the fluid path to the second communication outlet 41 defining a central jet and, in a lowered position shown in FIG. 3*b*, blocks the access of the fluid path to the first communication outlet 40, defining a peripheral jet.

The sprayhead 1 also comprises an actuating device 31 provided with a pushbutton 32. Pressing the pushbutton 32 causes the longitudinal rod 33 to move into the lowered position so as to define a peripheral jet. The pressure of the flowing water therefore keeps the longitudinal rod 33 in the lowered position for as long as the flow passes through the sprayhead 1. When the flow is interrupted, a return spring 37 brings the longitudinal rod 33 back into the raised position such that, when the flow is opened again, the sprayhead 1 supplies a central jet again.

As mentioned above, the pushbutton 32 crosses the containment casing 5, 6 and is transversely guided by a guide bush 63 of the functional portion.

The pushbutton 32 has an externally closed cylindrical body projecting outside of the guide bush 63 so as to allow pressing thereof by the user.

The pushbutton 32 also has a nose 34 contained in the cylindrical body and projecting towards the inside of the containment casing 5, 6. The nose 34 has a locking tooth 35 which, while allowing snap-engagement inside the guide bush 63 during mounting, also retains the element inside the containment casing 5, 6.

The free end of the nose 34 defines an inclined surface which is directed downwards and which cooperates with an oppositely arranged inclined surface defined by a transverse lug 36 joined to the longitudinal rod 33 by means of a threaded connection or other means suitable for the purpose. The transverse displacement of the pushbutton 32 thus causes downwards sliding of the transverse lug 36 along the inclined end of the nose 34 and a corresponding downwards displacement of the longitudinal rod 33.

The nose 34 also has two parallel lateral surfaces slidably guided inside oppositely arranged, parallel, internal surfaces of the selector body 3 by means of trapezoidal teeth shaped matching each other so as to define a sliding connection 42. In other words, the internal surfaces of the selector body 3 have a profile with trapezoidal teeth which mates, with due allowance for predefined play, with a similar profile formed externally on the walls of the nose 34.

The actuating device 31 also comprises means for elastic return of the pushbutton 32 into the extracted position. These elastic return means are formed in particular by two helical springs 39*a* which are inserted inside dedicated longitudinal cavities 39*b* of the pushbutton 32. Said cavities 39*b* are respectively arranged on the two sides of the nose 34. The free end of the springs 39*a* bears against a tangential flat surface of the selector body 3.

Obviously a person skilled in the art, in order to satisfy any specific requirements which might arise, may make numerous modifications and variations to the invention described above, all of which are contained moreover within the scope of protection of the invention, as defined by the following claims.

The invention claimed is:

1. A sprayhead for a faucet, of the type which is separable and can be independently handled with respect to a faucet body, comprising:

an inlet union, having a connecting mouth connectable to an extractable water supply hose;

a dispensing body, defining at least a first dispensing outlet and a second dispensing outlet;

a selector body, arranged between the inlet union and the dispensing body; said selector body including a fixed frame and a movable selection mechanism; said fixed frame internally defining at least an inner fluid path that connects the inlet union to the dispensing body; said movable selection mechanism being at least partially housed within said fixed frame and being actuatable from the outside so as to selectively place the connecting mouth in fluid communication either with the first dispensing outlet or with the second dispensing outlet; and a containment casing enclosing at least said dispensing body; said containment casing comprising two portions made of different materials: a structural portion, within which the fixed frame of the selector body is housed; and a functional portion, which covers at least partially said structural portion.

2. The sprayhead according to claim 1, wherein said structural portion defines a housing sleeve within which a portion of said inlet union, said selector body, and at least a portion of said dispensing body are contained.

3. The sprayhead according to claim 2, comprising an actuating device for the selection mechanism which can be accessed from the outside, said actuating device crossing an internal through-hole and an external through-hole which are aligned with each other and respectively formed in a lateral surface of the housing sleeve and in a lateral surface of the functional portion.

4. The sprayhead according to claim 3, wherein said actuating device comprises a pushbutton movable in a direction transverse to the longitudinal axis of the sprayhead, pressing of said pushbutton causing the movement of a longitudinal rod of the selection mechanism and the consequent modification of the dispensing outlet placed in fluid communication with the connecting mouth.

5. The sprayhead according to claim 4, further comprising elastic return means for bringing said pushbutton back into an external end-of-travel position following pressing.

6. The sprayhead according to claim 5, wherein said elastic return means comprise at least one spring inserted within a dedicated internal cavity of the pushbutton.

7. The sprayhead according to claim 4, wherein the travel of said pushbutton is guided within the dispensing body by means of a sliding connection with trapezoidal teeth.

8. The sprayhead according to claim 1, wherein said functional portion performs at least one function different from a merely structural function.

9. The sprayhead according to claim 1, wherein said functional portion performs one or more of the following functions: heat insulation; abrasion resistance; improvement of the user's grip; definition of an external volume; definition of an aesthetic effect.

10. The sprayhead according to claim 1, wherein said structural portion is made of a metallic material and said functional portion is made of a plastic material, or the structural portion and functional portion are made of two different plastic materials having different technical features.

11. The sprayhead according to claim 1, wherein said structural portion is an inner tubular jacket and said functional portion is an outer tubular jacket contiguously overlying and surrounding the inner tubular jacket.

* * * * *